United States Patent [19]

Bergsma et al.

[11] 4,442,597

[45] Apr. 17, 1984

[54] SHAVING APPARATUS

[75] Inventors: Wijtse Bergsma; Eelke S. Venema, both of Drachten, Netherlands

[73] Assignee: U.S. Philips Corporation, New York, N.Y.

[21] Appl. No.: 441,188

[22] Filed: Nov. 12, 1982

Related U.S. Application Data

[63] Continuation of Ser. No. 189,463, Sep. 22, 1980, abandoned.

[30] Foreign Application Priority Data

Oct. 18, 1979 [NL] Netherlands ..... 7907682

[51] Int. Cl.[3] ..... B26B 19/30

[52] U.S. Cl. ..... 30/43.6; 30/43.9

[58] Field of Search ..... 30/43.4, 43.5, 43.6, 30/43.9

[56] References Cited

U.S. PATENT DOCUMENTS

| | | | |
|---|---|---|---|
| 3,032,873 | 5/1962 | Vaes | 30/43.6 |
| 3,196,539 | 7/1965 | Jepson et al. | 30/43.9 |
| 3,401,453 | 9/1968 | Bauer | 30/43.9 |
| 3,590,482 | 7/1971 | Carr | 30/43.9 X |

FOREIGN PATENT DOCUMENTS

| | | | |
|---|---|---|---|
| 602367 | 4/1978 | U.S.S.R. | 30/43.6 |

*Primary Examiner*—James G. Smith

*Attorney, Agent, or Firm*—Rolf E. Schneider

[57] ABSTRACT

There is provided a shaving apparatus comprising a housing, a shaving head, and a resilient one-piece hinge element connecting the shaving head to the housing. The hinge element has a hinge pin portion and a connecting portion. The shaving head is formed to engage the hinge pin portion and retain the same under tension. The housing wall is provided with a slot to receive the connecting portion and to retain the same in place under elastic tension.

2 Claims, 12 Drawing Figures

SHAVING APPARATUS

This is a continuation of application Serial No. 189,463, filed Sept. 22, 1980, now abandoned.

This invention relates to a shaving apparatus comprising a housing and a shaving head, which is connected to the housing by means of a hinge construction, which hinge construction comprises a hinge pin and a connecting element between the hinge pin and the housing, which connecting element is secured in a slot in the housing wall.

Such a shaving apparatus is for example known from U.S. Pat. No. 3,032,873. The hinge construction described therein comprises separate components. In order to obtain a play-free hinge construction, the components need to be manufactured with close tolerances, so that these components are comparatively expensive.

It is the object of the present invention to provide inexpensive and play-free hinge construction and the invention is characterized in that the hinge pin and the connecting element together constitute an integral or unitary hinge element, which is realised as a single component from one piece of an elastic or resilient material.

A preferred embodiment is characterized in that the shaving head is provided with cams, behind which the hinge pin portion of the elastic hinge pin element can be retained under tension.

A special embodiment is characterized in that the hinge element is made of a wire material and is substantially U-shaped, the connecting section between the limbs of the U constituting the hinge pin portion, whilst the limbs of the U have bent ends, which extend at substantially right angles to the plane of the U and which ends are retained in corresponding slots in the housing wall under elastic tension.

Another special embodiment is characterized in that the hinge element is made of a sheet material, the hinge pin portion being constituted by a cylindrical bent end of said sheet material.

Yet another special embodiment is characterized in that the hinge element is made of a wire material and is substantially U-shaped, each of the limbs of the U being formed with a bent end which together constitute the hinge pin portion.

A related embodiment is characterized in that the bent end of a limb which constitutes the hinge pin portion is journalled in a bearing cam of the shaving head, the limb adjoining an oblique end face of the cam.

The invention will now be explained in detail in connection with the accompanying drawings, in which:

FIG. 1 schematically shows an elevation of a shaving apparatus.

Figure 2:
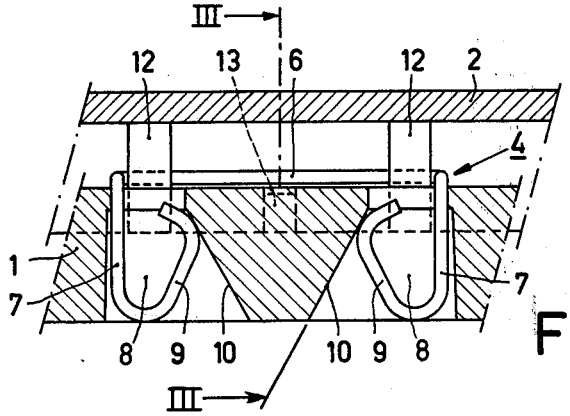
FIG. 2 is a partial cross-sectional view on an enlarged scale of the hinge construction taken on the line II—II in FIG. 1.
Figure 3:
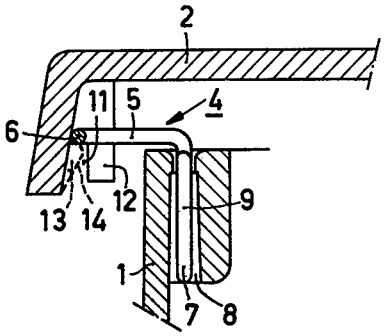
FIG. 3 is a partial cross-sectional view taken on the line III—III in FIG. 2.
Figure 4:
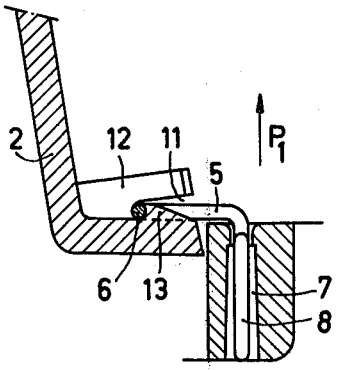
FIG. 4 is a partial cross-sectional view similar to that of FIG. 3, but with the shaving head in a swung-open position.
Figure 5:
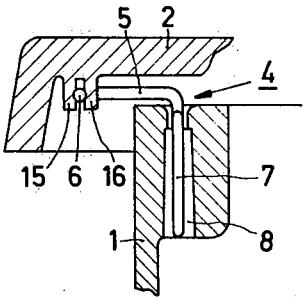

FIG. 5 in a cross-sectional view similar to that of FIG. 3 shows a variant of the embodiment of FIGS. 2 to 4, the same hinge element being employed.

Figure 6:
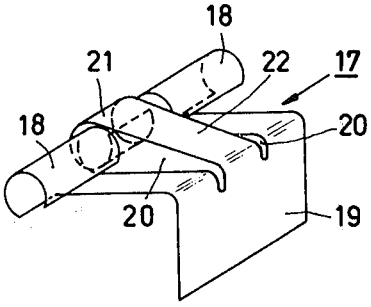

FIG. 6 is a perspective view of a variant of the hinge element.

Figure 7:
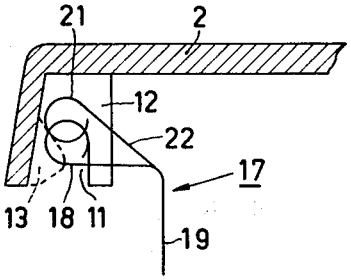
Figure 8:
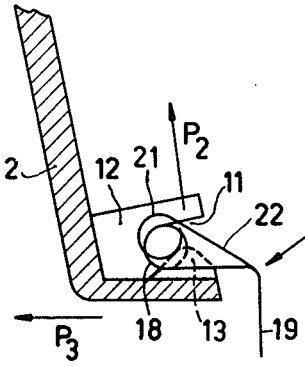

FIGS. 7 and 8, in a similar way as FIGS. 3 and 4 respectively, show on an enlarged scale the embodiment using the hinge element of FIG. 6, the housing of the shaving aparatus not being shown for the sake of simplicity.

Figure 9:
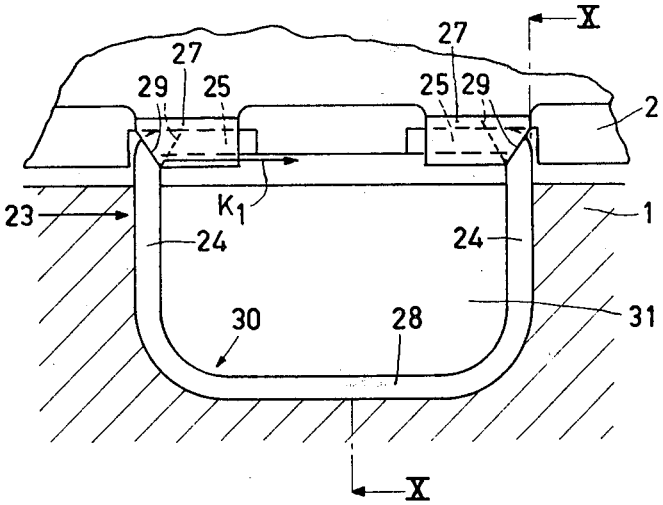

FIG. 9 is a cross-sectional view similar to that of FIG. 2, showing another variant of the hinge element.

Figure 10:
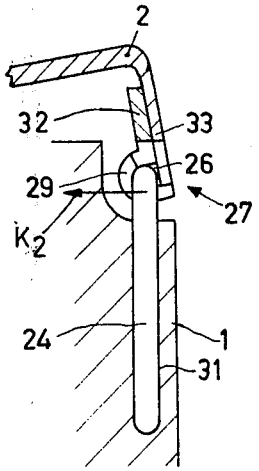

FIG. 10 is a cross-sectional view taken on the line X—X in FIG. 9.

Figure 11:
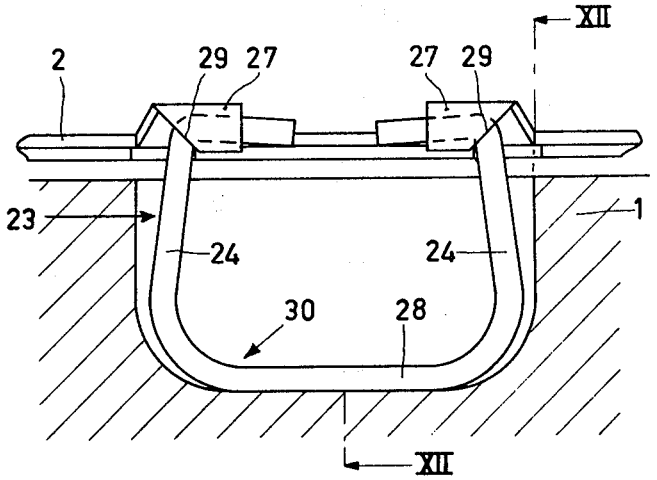
Figure 12:
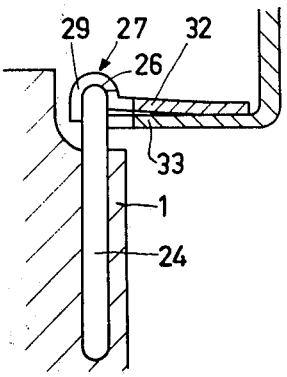

FIGS. 11 and 12 are cross-sectional views similar to FIGS. 9 and 10 respectively, the shaving head being shown in the open position, with FIG. 12 being taken on the line XII—XII in FIG. 11.

Figure 1:
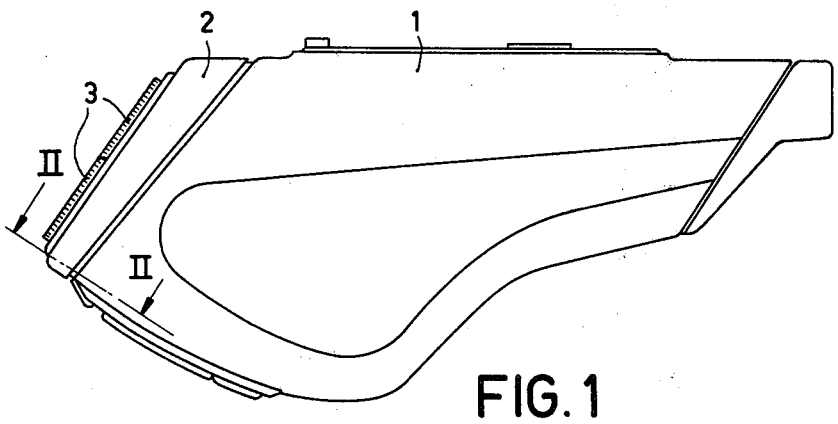

The shaving apparatus shown in FIG. 1 comprises a housing 1 and a shaving head 2, which is provided with shaving elements 3.

In order to enable the shaving elements 3 to be cleaned and shaved-off hair particles to be removed from the apparatus, the shaving head 2 is pivotally secured to the housing 1 by means of an integral hinge construction as shown in FIGS. 2 to 4. This hinge construction comprises a hinge element 4, which is formed or manufactured as a single or unitary component from one piece of a wire material, for example metal wire. The hinge element 4 is substantially U-shaped, the connecting section between the limbs 5 of the U constituting the hinge pin portion 6. The limbs 5 have bent ends 7, which extend at substantially right angles to the plane of the U, in which the limbs 5 and the hinge pin portion 6 are disposed.

The limbs 5 constitute the connecting element or portion between the hinge pin portion 6 and the housing 1, the bent ends 7 being situated in the slots 8 in the wall of the housing 1. The ends 7 are formed with hook-shaped portions 9, which under elastic tension engage with the downwardly and inwardly sloping oblique walls 10 of the slots, so that the ends 7 are retained in the slots without play. As a result of the elastic properties of the ends 7 they can be pulled out of the slots 8 when a suitable force is exerted in the direction $P_1$ (FIG. 4) or they can be fitted into said slots in the opposite direction.

The hinge pin portion 6 is journalled in slots or recesses 11 formed behind hook-shaped cams 12 of the shaving head 2. The pin is retained in these slots 11 by a cam 13 which is also formed on the shaving head. The positions of the hook-shaped cams 12 and the cam 13 relative to each other are such that in the assembled condition shown the hinge pin portion 6 is slightly elastically deformed and is thus retained in the slots 11 without play.

The cam 13 is formed with an oblique face 14, which facilitates sliding of the hinge pin portion 6 along the cam 13 during mounting.

It is also possible to secure the hinge pin portion 6 to the shaving head in a different manner, for example by clamping such pin portion between bearing-cam halves 15, 16 as shown in FIG. 5.

FIG. 6 shows a hinge element 17 formed integrally of a sheet material, which may be used instead of the hinge element 4 in the embodiments of FIGS. 2 to 5. The hinge pin portion 18 is then constituted by a cylindrical bent end of this component, a flat portion constituting the connecting element 19. The connecting element 19 may for example be clamped in a corresponding slot in the wall of the housing 1.

The slits 20 separate a central portion 21 from the hinge pin portion 18. This central portion 21 is coiled to a cylindrical shape in a direction opposite to that of the hinge pin portion 18 (FIGS. 7 and 8). The hinge element 17 can be secured to the shaving head 2 in the same way as in the embodiment of FIGS. 2 to 4, the hinge pin portion 18 being situated in the slots or recesses 11 behind the cams 12 and the central portion 21 bearing against the cam 13. In the open position the central portion 21 can deflect in the direction $P_2$ owing to the elasticity of the connecting arm or portion 22, so that the shaving head 2 can be removed in the direction $P_3$ from the hinge element 17.

The embodiment of FIGS. 9 to 12 also employs a U-shaped hinge element 23 made from one piece of metal wire. The limbs 24 of the U-shaped hinge element 23 are formed with bent ends 25. These ends 25 are journalled in the bores 26 of the cams 27 on the shaving head 2 and constitute two hinge pins for the shaving head. If no external forces are exerted on the hinge element 23, the hinge element will assume a shape as shown in FIGS. 11 and 12 with the shaving head 2 in the open position.

The limbs 24 are slightly inclined towards each other and, together with the connecting section 28, form the connecting element 30.

In the position shown in FIGS. 9 and 10, in which the shaving head 2 is closed, the hinge element 23 is elastically deformed to the shape shown. The limbs 24 then engage with the oblique end faces 29 of the cams 27 and exert forces on these end faces, whose components $K_1$ and $K_2$ are indicated in FIGS. 9 and 10 respectively. The forces $K_2$ exert a torque relative to the hinge pins 25 on the shaving head 2. The limbs 24 and the connecting section 28 constitute the connecting element 30 between the hinge pins 25 and the housing 1. This connecting element 30 is situated in a slot 31 in the housing wall and is firmly urged against the walls of said slot in the position shown in FIGS. 9 and 10.

If a latching device, known per se, which keeps the shaving head 2 in the closed position on the housing 1, is released, the shaving head is pivoted into the open position of FIGS. 11 and 12 under the influence of the turning moments of the forces $K_2$. The limbs 24 are then no longer urged against the walls of the slot 31, so that if necessary the shaving head 2 together with the hinge element 23 can readily be removed from the housing 1. The cams 27 are split, whilst the portions 32 and 33 can deflect elastically relative to each other. In this way it is prevented that the cams 27 are damaged in the position of FIGS. 11 and 12, in which the ends 25 are no longer in line with the bores 26.

Thus, the hinge element 23 shown in FIGS. 9 to 12 also provides the spring force for opening and keeping the shaving head in the open position.

In the embodiments described the hinge construction between the shaving head and the housing only requires a single separate component, the hinge element, which combines the hinge pin portion and the connecting element portion. This hinge element is made of one piece of an elastic or resilient material.

Mounting of the hinge element 4, 17, 23 is very simple, because the connecting element portion 7, 19, 30 needs merely be inserted into the associated slot in the housing, the hinge pin portion 6, 18, 25 being secured to the shaving head by means of cams.

The simple-to-manufacture hinge element 4, 17, 23 from an elastic material and the simple mounting procedure thus provide a very inexpensive hinge construction. Moreover, the hinge construction is practically without play owing to the elastic properties of the hinge element 4, 17, 23.

As variations in respect to the shape and dimensions of the hinge element can be realised in a simple manner, great freedom is obtained in respect of the choice of the location of the hinge pin portion relative to the housing. Therefore, the hinge elements are suitable for shaving-apparatus constructions where the shapes of the shaving head and the housing demand a special location of the hinge pin portion.

What is claimed is:

1. A shaving apparatus comprising a housing; a shaving head; a separate one-piece resilient metal wire hinge element for pivotally securing the shaving head to the housing, said wire hinge element being substantially U-shaped, the section between the limbs of the U constituting a hinge pin portion and each limb constituting a connecting portion, each limb being at its outer end at substantially a right angle to the plane of the U, the end of each limb being formed with a hook shape; means on the shaving head for engaging said hinge pin portion and retaining the same in place under tension; and two slots in a wall of the housing for respectively receiving said connecting portions, each slot being formed with a downwardly and inwardly sloping wall for engaging the hook-shaped end of the corresponding connecting portion and retaining the same in place under elastic tension without play.

2. A shaving apparatus according to claim 1, in which said shaving head engaging means comprises opposing cams providing a recess for retaining said hinge pin portion.

* * * * *

UNITED STATES PATENT AND TRADEMARK OFFICE

CERTIFICATE OF CORRECTION

PATENT NO. : 4,442,597

DATED : April 17, 1984

INVENTOR(S) : Wijtse Bergsma

It is certified that error appears in the above-identified patent and that said Letters Patent is hereby corrected as shown below:

Column 4, line 36 after"being" insert --bent--.

Signed and Sealed this

*Thirtieth* Day of *October 1984*

[SEAL]

*Attest:*

GERALD J. MOSSINGHOFF

*Attesting Officer*

*Commissioner of Patents and Trademarks*